US005387775A

United States Patent [19]

Kang

[11] Patent Number: 5,387,775

[45] Date of Patent: Feb. 7, 1995

[54] APPARATUS FOR THE PLASMA DESTRUCTION OF HAZARDOUS GASES

[75] Inventor: Michael Kang, Los Alamos, N. Mex.

[73] Assignee: The United States of America as represented by the United States Department of Energy, Washington, D.C.

[21] Appl. No.: 41,019

[22] Filed: Mar. 31, 1993

[51] Int. Cl.[6] ..... B23K 9/00; F23G 7/04

[52] U.S. Cl. ..... 219/121.52; 219/121.43; 219/121.49; 110/242; 110/244; 422/186.22; 422/173

[58] Field of Search ..... 219/121.43, 121.36, 219/121.48, 121.49, 121.51, 121.52, 75; 110/242, 243, 244, 250; 422/186.21, 186.22, 173

[56] References Cited

PUBLICATIONS

T. C. Manley, "The Electric Characteristics of the Ozonator Discharge," Trans. Electrochem. Soc. 84, 83 (1943).

*Primary Examiner*—Mark H. Paschall

*Attorney, Agent, or Firm*—Samuel M. Freund; William A. Eklund; William R. Moser

[57] ABSTRACT

A plasma cell for destroying hazardous gases. An electric-discharge cell having an electrically conducting electrode onto which an alternating high-voltage waveform is impressed and a dielectric barrier adjacent thereto, together forming a high-voltage electrode, generates self-terminating discharges throughout a volume formed between this electrode and a grounded conducting liquid electrode. The gas to be transformed is passed through this volume. The liquid may be flowed, generating thereby a renewable surface. Moreover, since hydrochloric and hydrofluoric acids may be formed from destruction of various chlorofluorocarbons in the presence of water, a conducting liquid may be selected which will neutralize these corrosive compounds. The gases exiting the discharge region may be further scrubbed if additional purification is required.

6 Claims, 4 Drawing Sheets

APPARATUS FOR THE PLASMA DESTRUCTION OF HAZARDOUS GASES

This invention was made with government support under Contract No. W-7405-ENG-36 awarded by the U.S. Department of Energy. The government has certain rights therein.

BACKGROUND OF THE INVENTION

The present invention relates generally to destruction of hazardous gaseous materials, and more particularly to the destruction of hazardous gases using an electric-discharge plasma cell having one liquid electrode.

Electric-discharge "plasma cells" are dielectric barrier discharge cells often referred to as ozonizer cells, since they are widely used in the industrial generation of ozone. See, e.g., T. C. Manley, "The Electric Characteristics of the Ozonator Discharge," Trans. Electrochem. Soc. 84, 83 (1943). Multiple, self-terminating microdischarges occur throughout the discharge volume as a result of the application of an alternating high-voltage waveform to one of the two electrodes. The feed gas typically contains oxygen and/or water vapor; highly reactive O and OH radicals being produced therefrom in the microdischarges, which species react with and convert the hazardous components of the feed gas into less hazardous forms such as water and carbon dioxide, or possibly carbon monoxide.

Two difficulties are encountered in the use of currently available plasma cells in the destruction of hazardous components of the feed gas. Hydrochloric acid forms within the plasma cell from the destruction of chlorocarbon compounds in the feed gas. Additionally, the discharge volume may become blocked by reactions therein and from wall-reaction products.

Accordingly, it is an object of the present invention to provide an electric-discharge plasma cell for destruction of hazardous gases, where the electrode in contact with hostile gases, either in the feed stream or formed in the plasma does not corrode.

Another object of the invention is to provide an electric-discharge plasma cell for destruction of hazardous gases, where reaction products may be readily removed, thereby eliminating cell blockage.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the electric-discharge plasma cell of the present invention suitable for decomposing gases includes an elongated, substantially planar, high-voltage electrode; a high-voltage generator for providing an alternating high-voltage waveform to this electrode, a grounded, conducting liquid located parallel to and spaced-apart from the high-voltage electrode which forms a grounded electrode; an elongated, planar dielectric barrier located adjacent to the high-voltage electrode for preventing surface arcing between the high-voltage electrode and the grounded electrode, there being a volume formed between the dielectric barrier and the grounded electrode through which the gases to be decomposed are flowed and within which multiple, self-terminating discharges occur throughout; and apparatus for flowing the gases to be decomposed through the volume. For nonconducting or poorly conducting liquid electrodes, a grounded grid placed beneath the surface thereof and parallel thereto would provide the requisite conductivity to sustain a discharge.

Benefits and advantages of the present invention include a plasma cell where the electrodes in contact with corrosive gases do not corrode, and where reaction products, which might otherwise block the gas flow, can readily be removed. Additionally, cleaning and/or neutralizing solutions can be readily added to the cell to further treat gases to be processed and reaction products thereof.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Briefly, the present invention includes an electric discharge cell having an electrically conducting electrode onto which an alternating high-voltage waveform is impressed and a dielectric barrier adjacent thereto, forming a high-voltage electrode, generates self-terminating discharges throughout a volume formed between this electrode and a grounded, conducting liquid electrode. The gas to be transformed is passed through this volume. The liquid may be flowed, generating thereby a renewable conducting surface. Moreover, since corrosive materials may be formed from destruction of certain gases (e.g., hydrochloric and hydrofluoric acids in the situation where various chlorofluorocarbons are destroyed in the presence of water), a conducting liquid may be selected which will neutralize these corrosive compounds. The gases exiting the discharge region may be further scrubbed if additional purification is required.

Figure 1:
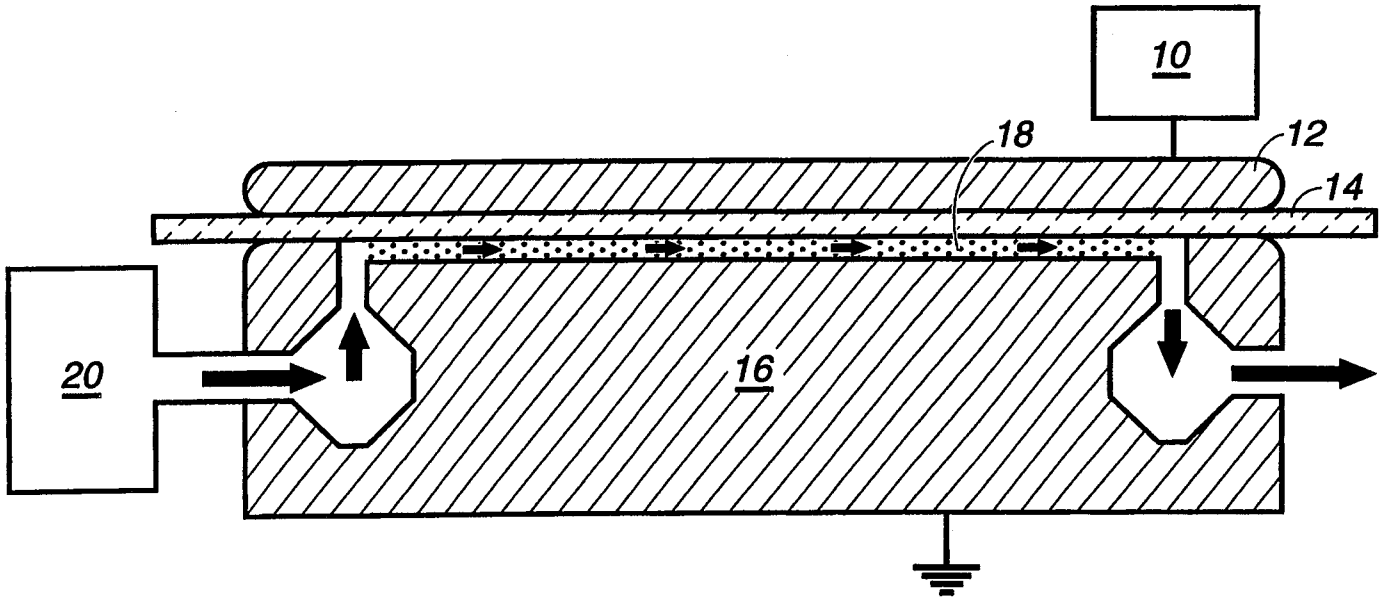
FIG. 1 is a schematic representation of a typical plasma cell of the type currently in use, showing the interrelationship among the high voltage electrode, the dielectric barrier, and the ground electrode.

Reference will now be made in detail to the present preferred embodiments of the invention, examples of which are illustrated in the accompanying drawings. Similar or identical structure therein will be represented by identical callouts. Turning now to the drawings, FIG. 1 is a schematic representation of a typical, currently available plasma cell. High-voltage power supply, 10, impresses an alternating, highvoltage onto electrically conducting electrode, 12. Dielectric barrier, 14, is placed next to electrode 12 in order to prevent a continuous discharge in volume 18 between electrode 12 and ground electrode 16. This would short out the plasma cell and likely damage power supply 10. A similar result would be obtained if the dielectric material developed a puncture. The dielectric barrier is generally made larger than the high voltage electrode to prevent surface tracking. The gas to be processed or reacted in the discharge volume is pumped into this volume by pump 20. As stated above, two difficulties are encountered in the use of such plasma cells in the reaction of components of a gas. Hydrochloric and/or hydrofluoric acid forms within the cell from the destruction of chlorofluorocarbon compounds in the feed gas. Additionally, the discharge volume 18 may become blocked by reactions therein and from wall-reaction products.

Figure 2:
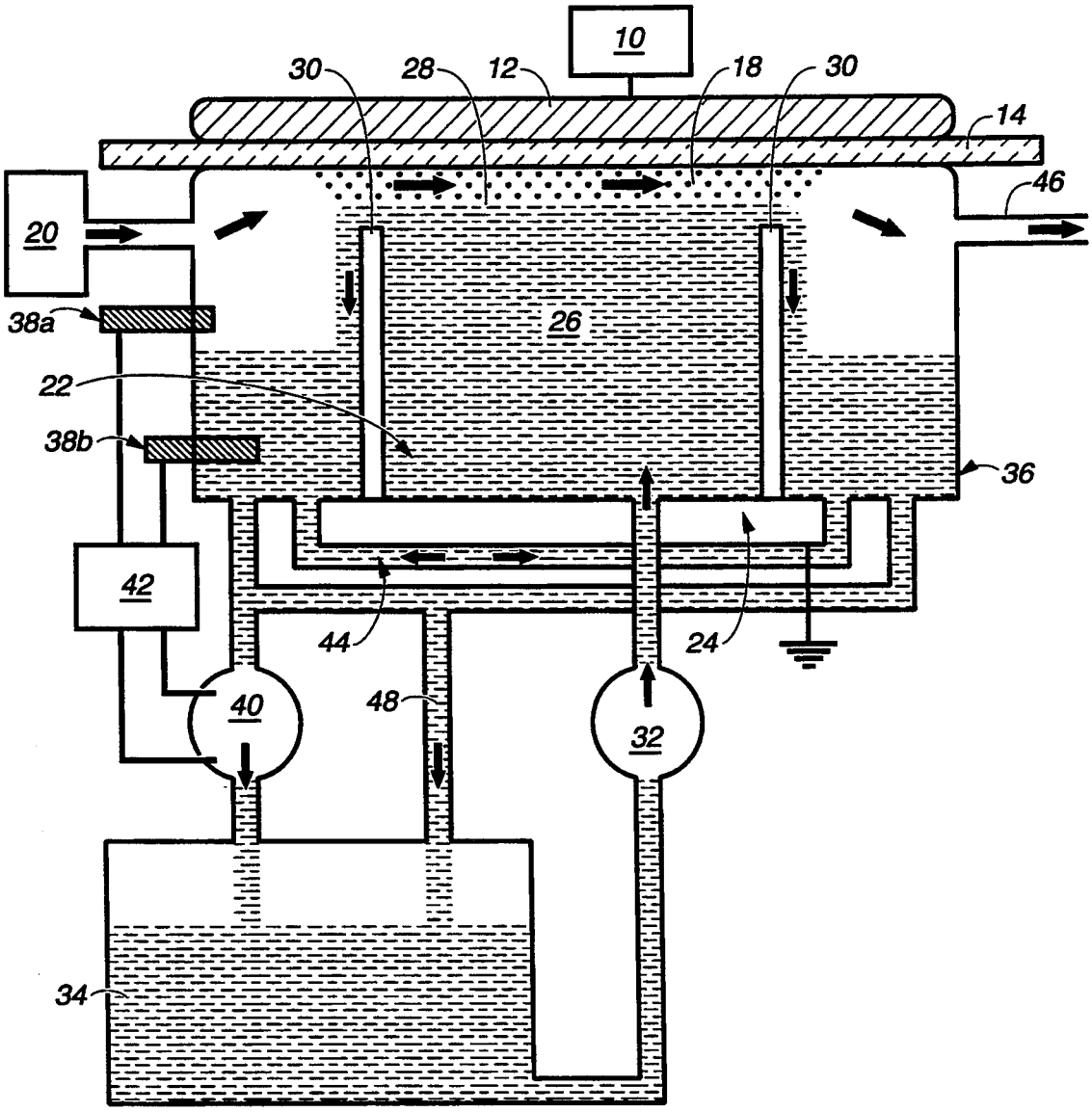
FIG. 2 is a schematic representation of the plasma cell of the present invention showing, in particular, the replacement of the ground electrode with a liquid electrode and flow system.

FIG. 2 is a schematic representation of the plasma cell of the present invention. Ground electrode 16 in FIG. 1 hereof is replaced by liquid electrode 22 includes a grounded, metallic container 24, which serves both as a reservoir for an electrically conducting liquid 26, and as a generator of a planar, ground electrode surface 28 to which the electric discharges from high-voltage electrode 12 can occur. Walls 30 of container 24 act as a dam over which liquid 26 can be flowed in the event that the electrode surface is to be renewed. This is achieved using pump 32 to add liquid to container 24. Storage/treatment tank 34 permits additional liquid to be added to container 24. A second, larger container 36 collects the overflow from container 24. High/low sensors 38a,b and a second liquid pump 40 are used to control the liquid level in second container 36 through control unit 42. A liquid-level equalization tube 44 balances any unequal flow over the walls 30 of container 24. Liquid level in container 36 must be maintained above the liquid return lines to storage/treatment tank 34, but below the gas entry and exit locations in the second container in order to prevent mixing of the media. The gas to be reacted is pumped through discharge volume 18 by gas pump 20, and the reacted gas exits the second container through exhaust 42., perhaps for further treatment, if necessary. In the event that corrosive or otherwise harmful materials dissolve in liquid 26 as a result of processing various gases, storage/treatment tank 34 may be used to neutralize these materials, thereby replenishing the conducting liquid for grounded electrode 22. In operation, pump 32 operates continuously to maintain the flow of liquid over walls 30. Pump 40 operates in response to the level sensors 38*a,b* in second container 36. Liquid flows continuously through bypass tube 48 The liquid flow rate through pump 32 is greater than that through bypass 48. Thus, with pump 32 operating and pump 40 off, the liquid level in the second container rises. When the liquid reaches high level sensor 38*a*, pump 40 is turned on. The flow rates of the pumps and the size of bypass tube 48 are selected such that the combined flows of pump 40 and bypass tube 48 exceed that of pump 32. Therefore, the liquid level in tank 36 drops with both pumps operating. When the liquid level reaches low level sensor 38*b*, pump 40 is turned of, and the liquid level begins to rise once again until the high level sensor is reached.

Figure 3:
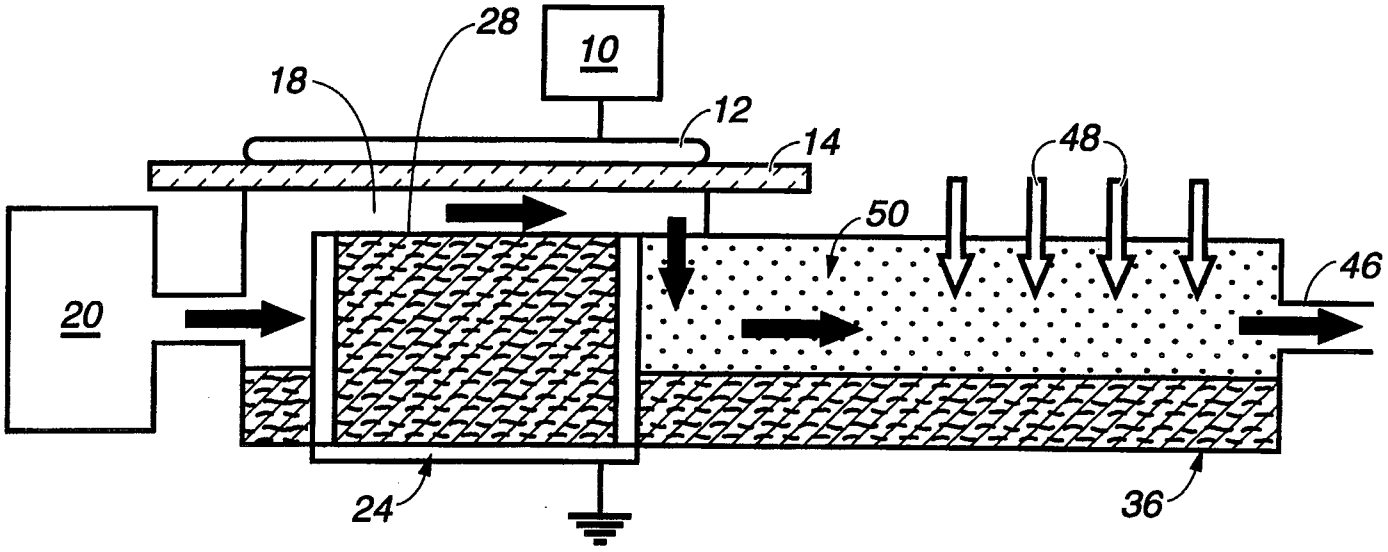
FIG. 3 is a schematic representation of the plasma cell of the present invention as described in FIG. 2 hereof, wherein a scrubber system has been added in order to further treat the feed gas after passage thereof through the plasma.

FIG. 3 is a schematic representation of a modification of the apparatus of the present invention described in FIG. 2 hereof. If the processed gas exiting discharge volume 18 requires further treatment, say to remove the acid gases hydrogen chloride and/or hydrogen fluoride, a neutralizing solution 48 may be added to wet packing material 50 which provides a large surface area to treat the exiting gases before being discharged through exit port 46.

Phosgene has been observed to be formed in the destruction of trichloroethylene under certain operating conditions in plasma cells having aluminum-grounded electrodes. This toxic material may be destroyed by increasing the applied electrical power to the plasma cell or by water scrubbing. Additionally, carbonyl fluoride is believed to be formed from the destruction of fluorinated hydrocarbons under similar conditions. Since both of these materials are readily hydrolyzed to carbon dioxide and a gaseous hydrogen halide, the use of an aqueous ground electrode, according to the teachings of the present invention, would both accomplish the hydrolysis step. It would also neutralize the acid gases formed in the discharge and from the hydrolysis of the discharge products without having to resort to a more vigorous electrical discharge.

Figure 4:
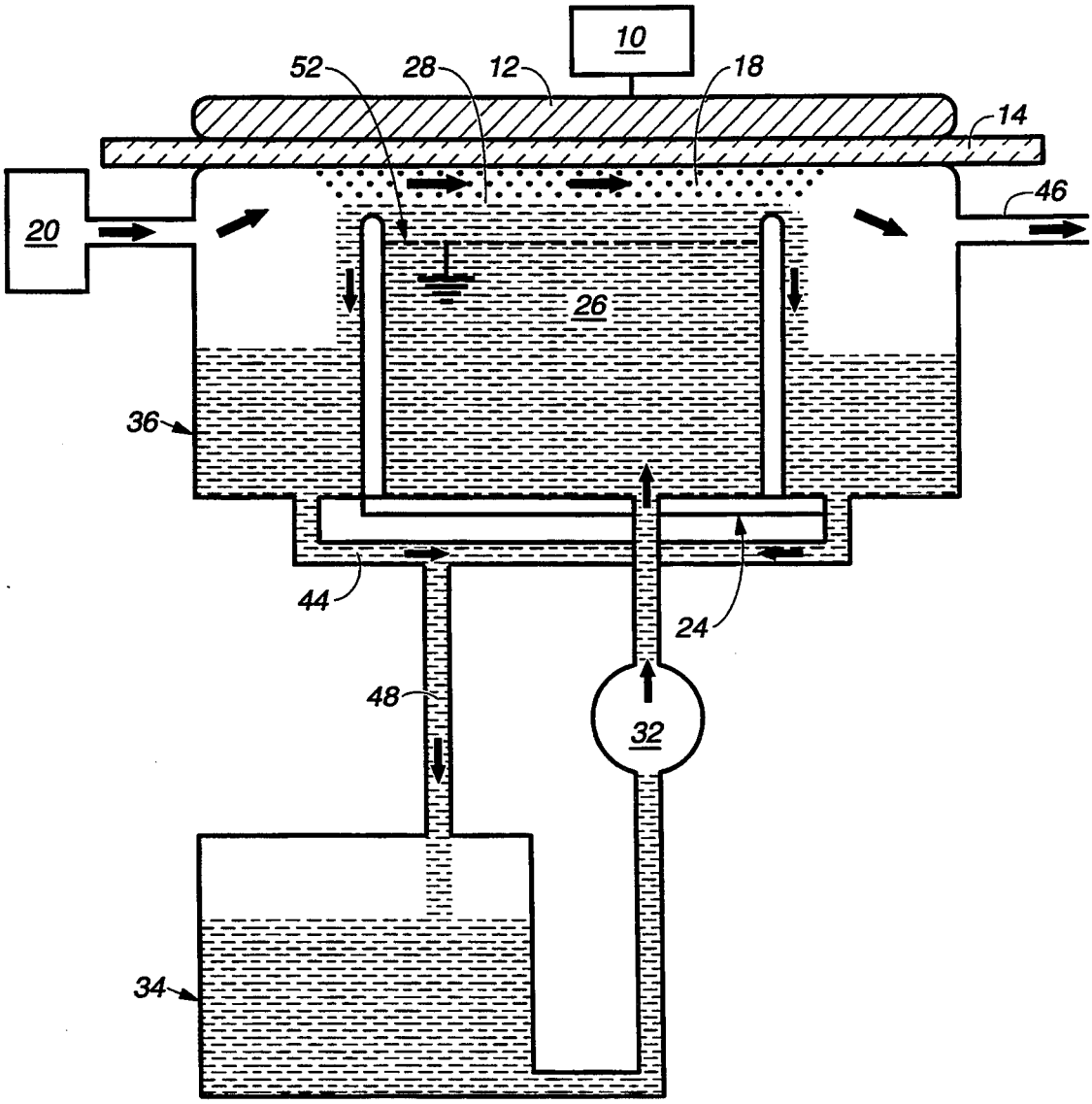
FIG. 4 is a schematic representation of another embodiment of the present plasma cell, wherein a grounded conducting element is placed within the liquid electrode and below the surface thereof in order to increase the overall conductivity of the grounded electrode in the situation where liquids having poor electrical conductivity are employed.

FIG. 4 is a schematic representation of a further modification of the apparatus of the present invention described in FIG. 2 hereof. In the event that nonconducting liquids or those having poor conductivity are to be employed, wire screen 52 placed below the surface 28 of conducting electrode 22 will improve the electrical discharge characteristics in discharge volume 18.

The subject apparatus has been tested using tap water as the conducting liquid electrode. Compressed air was employed as the gas to be processed. An electrical discharge was observed which is typical of that observed in cells having metal electrodes.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable other skilled in the art to best utilize the invention in various embodiments and with various modifications as are suited to the particular use contemplated. It is intended that the scope of the invention be defined by the claims appended hereto.

What is claimed is:

1. An electric-discharge plasma cell for decomposing gases, which comprises in combination:

a. an elongated, substantially planar, high-voltage electrode;

b. voltage generation means for providing an alternating high-voltage waveform to said high-voltage electrode;

c. a horizontally disposed, electrically conducting liquid located substantially parallel to and spaced-apart from said high-voltage electrode, said liquid being electrically grounded, forming thereby a grounded electrode;

d. an elongated, substantially planar dielectric barrier disposed adjacent to said high-voltage electrode and having dimensions such that surface arcing between said high-voltage electrode and said grounded electrode cannot occur, and such that a volume is formed between said dielectric barrier and the grounded electrode through which the gases to be decomposed are flowed and within which multiple, self-terminating discharges occur throughout; and e. means for flowing the gases to be decomposed through the volume.

2. The apparatus as described in claim 1, further comprising liquid holding means for containing said conducting liquid, said liquid holding means having walls which form a substantially planar, horizontal open top surface thereof, and means for flowing said conducting liquid over the open walls of said liquid holding means in order to provide a continuously replenished surface for the grounded electrode.

3. The apparatus as described in claim 1, further comprising a substantially planar, grounded electrical conductor disposed substantially parallel to the surface of the grounded electrode and located within said conducting liquid, for improving the electrical conductivity of the grounded electrode.

4. The apparatus as described in claim 3, further comprising a substantially planar, grounded electrical conductor disposed substantially parallel to the surface of the grounded electrode and located within said conducting liquid, for improving the electrical conductivity of the grounded electrode, said electrical conductor permitting said liquid to flow over the open walls of said liquid holding means.

5. The apparatus as described in claim 1, further comprising means for treating decomposition products dissolved in said liquid and formed as a result of the interaction of the gases to be decomposed and the multiple, self-terminating discharges in the volume.

6. The apparatus as described in claim 1, further comprising means for treating gaseous decomposition products remaining after the gases to be decomposed exit the discharge volume.

* * * * *